United States Patent [19]

Brooks et al.

[11] 4,426,845

[45] Jan. 24, 1984

[54] NOISE REDUCTION IN PNEUMATICALLY DRIVE HYDRAULIC PUMP

[75] Inventors: George W. Brooks, La Conner; John W. Hart, Everett; Egil R. Pettersen, Kent, all of Wash.

[73] Assignee: The Boeing Company, Seattle, Wash.

[21] Appl. No.: 234,759

[22] Filed: Feb. 17, 1981

[51] Int. Cl.[3] ..... F16D 33/02

[52] U.S. Cl. ..... 60/347; 60/409; 415/36; 415/119; 417/47

[58] Field of Search ..... 60/347, 370, 407, 409; 415/36, 119; 417/47; 98/1.5; 181/237, 253, 254

[56] References Cited

U.S. PATENT DOCUMENTS

| | | | |
|---|---|---|---|
| 2,095,635 | 10/1937 | Giffen | 181/47 |
| 2,563,509 | 8/1951 | Baird | 181/35 |
| 2,693,088 | 11/1954 | Green | 98/1.5 |
| 3,122,308 | 2/1964 | Andersson et al. | 417/310 |
| 3,170,483 | 2/1965 | Milroy | 137/553 |
| 3,192,848 | 7/1965 | Townsend | 98/1.5 |
| 3,208,551 | 9/1965 | Carls | 181/36 |
| 3,304,051 | 2/1967 | Calhoun | 60/407 |
| 3,568,435 | 3/1971 | May | 60/347 |
| 3,675,732 | 7/1972 | Rosen et al. | 181/36 |
| 3,750,839 | 8/1973 | McNabney | 181/50 |
| 3,884,664 | 5/1975 | Edwards | 62/402 |
| 4,093,406 | 6/1978 | Miller | 417/401 |
| 4,096,699 | 6/1978 | Zitelli | 415/36 |
| 4,118,935 | 10/1978 | Andersson | 415/36 |

*Primary Examiner*—Ronald C. Capossela
*Attorney, Agent, or Firm*—Christensen, O'Connor, Johnson & Kindness

[57] ABSTRACT

Disclosed is a method and apparatus for reducing the level of noise emitted by air turbine machinery, particularly a pneumatically driven hydraulic pump for an airplane, wherein a modulating valve meters the flow of air from a source of pressurized air through a conduit to an air turbine to control the speed of the turbine. A pressure regulating valve is located in the air conduit upstream of the modulating valve to regulate and maintain the upstream pressure on the modulating valve at substantially the minimum pressure required in order to permit operation of the air turbine over its full range of speed as the amount of airflow is varied with the modulating valve. Reducing the pressure across the modulating valve in this manner minimizes the production of supersonic airflow and attendant noise by the modulating valve, which noise is otherwise propagated to the atmosphere through the turbine exhaust stream and is additionally radiated by the turbine casing. Preferably, a muffler is interposed in the air conduit between the pressure regulating valve and the pressure modulating valve. In another aspect of the invention, a pressure feedback conduit couples an actuator of the pressure regulating valve to a point in the air conduit immediately upstream from the pressure modulating valve such that the pressure regulating valve operates under pneumatic feedback control to maintain a substantially constant upstream pressure on the pressure modulating valve. Preferably, such upstream pressure maintained on the modulating valve is substantially equal to the maximum inlet pressure to the air turbine, such that the modulating valve is operated in a wide-open position with negligible pressure drop to obtain full speed of the air turbine.

13 Claims, 1 Drawing Figure

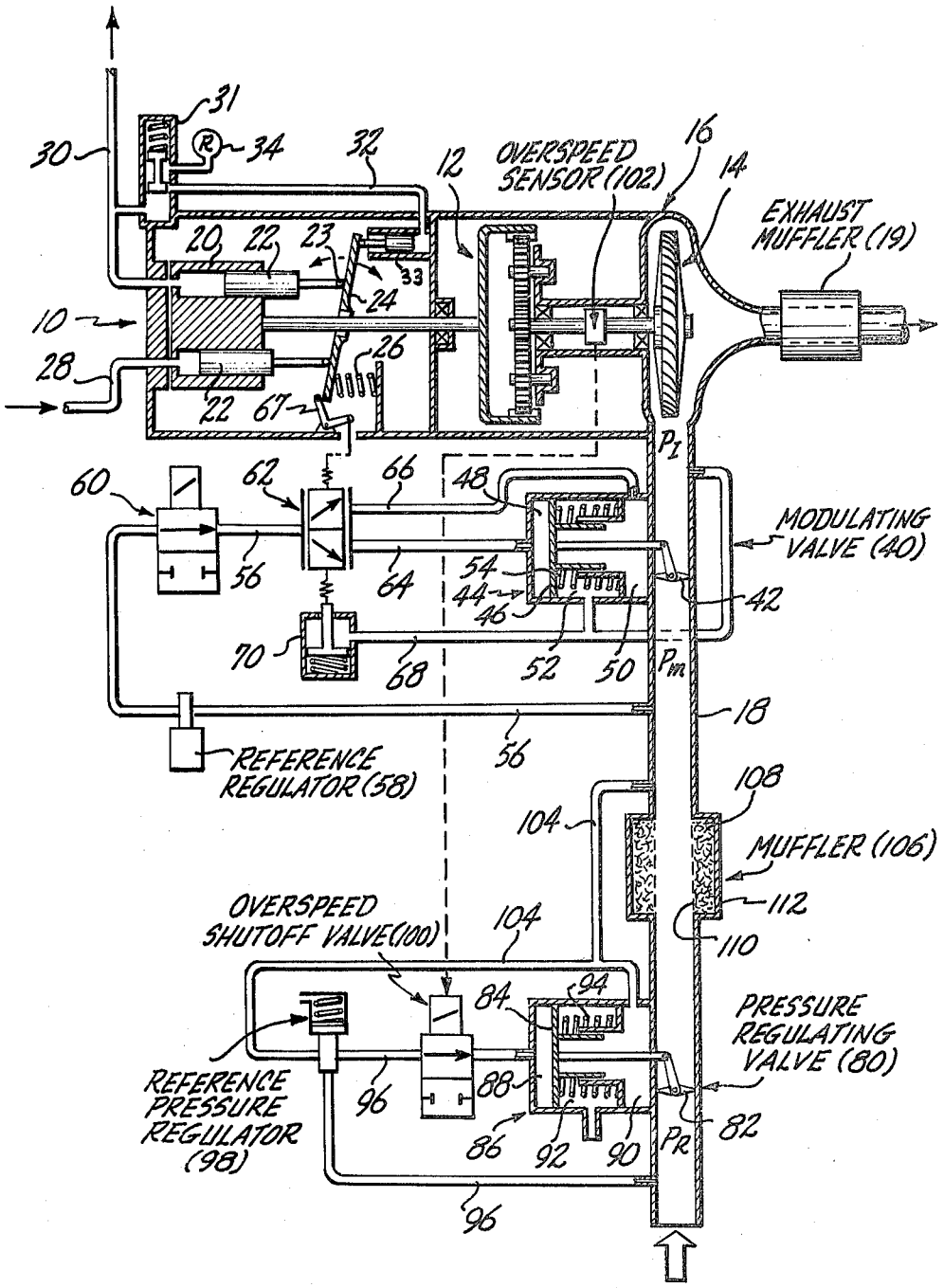
OVERSPEED SENSOR (102)
EXHAUST MUFFLER (19)
MODULATING VALVE (40)
REFERENCE REGULATOR (58)
MUFFLER (106)
OVERSPEED SHUTOFF VALVE (100)
PRESSURE REGULATING VALVE (80)
REFERENCE PRESSURE REGULATOR (98)

NOISE REDUCTION IN PNEUMATICALLY DRIVE HYDRAULIC PUMP

BACKGROUND OF THE INVENTION

The present invention is generally related to noise reduction techniques and devices for pneumatically driven turbine machinery and, more particularly, to noise reduction techniques and devices for pneumatically driven hydraulic pumps of the type utilized to power various systems within an aircraft. Before turning to the present invention, the following brief description of the pertinent operating environment is set forth as a background to the noise problem to which the invention is directed.

Pneumatically driven hydraulic pumps are commonly employed in commercial transport airplanes to provide the hydraulic power required by various hydraulic actuators and motors such as those that drive the landing gear, flaps, and spoilers. Such pump assemblies generally include a pneumatically driven turbine which drives a hydraulic pump unit, with the entire assembly contained as a unit in a housing or casing. The turbine is typically driven with bleed air supplied by one or more of the gas turbine engines that propel the aircraft. The pressurized hydraulic fluid provided by the pump is metered to the various hydraulic actuators in a conventional manner.

In one particular type of pneumatically driven pump assembly employed on large commercial airplanes, the shaft of the air turbine is coupled through a reduction gear assembly to the main shaft of a variable-displacement rotary pump. Engine bleed air is supplied to the turbine through a modulating valve which meters the airflow in response to hydraulic demand and thereby controls the turbine speed as well as the speed of the pump unit. The pump assembly additionally includes a solenoid-actuated shutoff valve in the air supply duct, which operates in response to a signal from a turbine overspeed sensor, to interrupt pneumatic power to the turbine in the event of an overspeed condition.

The pump assembly described above is ordinarily located in the fuselage of the airplane. Like other air turbine machinery, the pump assembly emits substantial levels of noise. Because of its proximity to the passenger compartment in the case of a commercial airliner, the pump has been an object of noise reduction efforts. In this regard, it has been recognized that a significant proportion of the acoustic energy generated within the pump assembly is emitted from the turbine scroll of the pump assembly casing and is transmitted inwardly through the surrounding enclosure structure to contribute to cabin noise in the passenger compartment. Another major portion of the acoustic energy is transmitted as exhaust noise outside the airplane, primarily through the turbine air exhaust duct which opens outwardly from the fuselage. This exhaust noise contributes to what is known as ramp noise in the ground service areas around the airplane and often reaches unacceptably high levels. Accordingly, as part of an overall effort to make commercial airplanes quieter, and to reduce cabin noise and ramp noise in particular, it has been sought to reduce the noise level of this type of pump assembly.

The noise emitted by the pump assembly is somewhat characteristic of turbine noise in frequency and spectral distribution. Since pneumatically driven turbines are well known to emit high levels of noise, it has been largely assumed previously that the turbine within the pump assembly is the major source of noise. Since it is generally accepted that there is no practical way to greatly reduce the generation of noise by the turbine without impairing its efficiency, previous efforts toward noise reduction have been directed to containing or absorbing the noise emitted by the pump assembly, rather than reducing the generation of the noise at its source. In this regard, as noted above, it has been recognized previously that most of the noise is radiated in two modes—as case-radiated noise and as exhaust-radiated noise. Exhaust-radiated noise has been attenuated, for example, by providing a muffler in the air exhaust duct leading from the turbine. Case-radiated noise has been attenuated by enclosing or surrounding the entire assembly with an acoustically absorbent material. However, these approaches have not been altogether satisfactory because they add weight to the pump assembly and hinder access for servicing and maintenance.

Accordingly, it is the primary object and purpose of the present invention to provide a method and apparatus for reducing the level of noise generated by pneumatically driven turbine machinery, particularly a pneumatically driven hydraulic pump in an airplane. More specifically, it is an object of the invention, for reasons that will become apparent from the following discussion, to provide a method and apparatus for reducing noise emission from turbine machinery wherein a modulating valve regulates flow of gas from a source of high pressure gas to a turbine.

It is a further object of the present invention to achieve the foregoing objects in a pneumatically driven hydraulic pump in an airplane without significantly increasing the weight of the assembly.

It is another object, also for reasons that will become apparent from the following discussion, to provide a method and apparatus for reducing the level of noise generated by a pneumatically driven hydraulic pump that is controlled by a modulating valve, which method and apparatus does not diminish the control responsiveness of the turbine with respect to the modulating valve.

SUMMARY OF THE INVENTION

It has been discovered, through detailed acoustic analyses conducted under the direction of the applicants, that the major source of noise in the pump assembly discussed above is not the turbine which drives the rotary pump unit, nor is it any other component within the turbine assembly. Surprisingly, and contrary to previous assumption and belief, the modulating valve that controls turbine and pump speed is the primary source of noise.

Upon further investigation, applicants have discovered that the high noise level results when a relatively large pressure drop occurs across the modulating valve. Particularly high noise levels result when the pressure drop across the valve is greater than approximately 50 percent of the bleed air pressure, a condition that results in supersonic airflow and accompanying generation of shock waves in the air intake duct.

It is further found that relatively little of the noise generated at the modulating valve is actually emitted from the modulating valve or from the adjacent bleed air intake duct, which is one reason why the modulating valve was not previously thought to be a major source of noise. Rather, most of the noise from the valve is conducted downstream with the airflow to the turbine, where it is partially transmitted through the turbine with the airflow, to be emitted as exhaust noise, and partially reflected and scattered by the turbine and transmitted through the turbine housing to be emitted as case-radiated noise. Additionally, the modulating valve noise, in passing through the turbine, assumes some of the "buzz-saw" spectral distribution that typically characterizes turbine noise, which is another reason why the noise was previously thought to be generated at the turbine, rather than at the modulating valve.

Having discovered that the modulating valve is the primary source of noise in the pump assembly, various approaches toward reducing the valve noise were considered. For example, it was considered to interpose a muffler in the bleed air duct between the modulating valve and the turbine to thereby attenuate the modulating valve noise prior to its reaching the turbine. One disadvantage of this approach, however, is that the introduction of a muffler results in an airflow lag and a pressure drop between the modulating valve and the turbine. As a result, there is a reduction in the responsiveness of the turbine to the operation of the modulating valve. Since the modulating valve is the primary means for controlling the speed of the turbine as well as the speed of the hydraulic pump, the resulting reduction in control over the turbine speed has been considered to render this approach unacceptable.

In another approach, it has been sought to select the type of modulating valve so as to minimize the valve noise. To this end the relative noise levels produced by different types of valves under the same operating conditions have been examined. Specific types of valves that have been compared include a butterfly valve, a sleeve valve and a poppet valve. It has been found, however, that the noise level is substantially independent of the type of valve. Rather, the level of the valve noise is dependent almost exclusively on such variables as the absolute pressure drop across the valve, the ratio of the upstream pressure to the downstream pressure, and the mass flow rate across the valve, i.e., variables that are largely independent of the mechanical configuration of the valve.

Having considered these various approaches to the newly discovered problem of modulating valve noise, the applicants have found that, in accordance with the present invention, substantial valve noise reduction may be obtained by providing a pressure regulating valve in the bleed air duct upstream from the modulating valve to reduce the air pressure applied to the modulating valve. The pressure regulating valve is preferably selected to reduce the air pressure applied to the modulating valve to the minimum pressure necessary to meet the maximum pneumatic pressure requirements of the turbine. The pressure regulating valve thus reduces, and preferably minimizes, the pressure drop across the modulating valve and thereby substantially reduces the level of the noise generated by the modulating valve. Additionally, regulation of the pressure applied to the modulating valve stabilizes the supply of air to the modulating valve and thereby mitigates the adverse effects of ordinary occasional fluctuations in the pressure of the air supplied to the pump assembly.

For example, where the bleed air is normally provided at a relatively high pressure, such as 60 psig, and the maximum, or full-speed, operating pressure of the turbine is 13 psig, the pressure regulating valve is preferably set to reduce the pressure applied to the modulating valve from 60 to 13 psig. The modulating valve may then be operated between a closed position and a fully open position to deliver air to the turbine over a pressure range of 0 to 13 psig. As a result, there is a minimal pressure drop across the modulating valve when in its fully open position, and the pressure drop rises to a maximum of only 13 psig as the valve is closed. The maximum pressure drop of 13 psig is not a problem in this situation, however, since it only occurs when the valve is nearly closed, and the sound generated under such a condition is tolerable because the mass air flow rate is low.

In another aspect of the invention utilized in the preferred embodiment, the separate overspeed shutoff valve referred to above is eliminated and its function consolidated in the pressure regulating valve. By coupling the overspeed sensor to an appropriate solenoid associated with the pressure regulating valve, the pressure regulating valve serves in a dual function to reduce the noise level of the modulating valve and also operate as a backup overspeed shutoff valve.

The introduction of the pressure regulating valve and the occasionally substantial pressure drop across it results in the pressure regulating valve itself being a new source of noise. Accordingly, in another aspect of the invention, there is further provided a muffler interposed in the bleed air duct between the pressure regulating valve and the modulating valve. The muffler operates to attenuate noise generated at the pressure regulating valve prior to its being transmitted through the modulating valve to the turbine, where it might otherwise be conducted through and radiated from the casing and the exhaust duct. This embodiment of the invention preferably further includes a pressure conduit that couples the duct at a point downstream of the muffler to the pressure regulator, such that the pressure regulator valve is responsive to and seeks to maintain at a substantially constant level the pressure supplied at the modulating valve.

These and other aspects and advantages of the invention are more apparent by reference to the accompanying FIGURE and the following detailed description of the preferred embodiment.

BRIEF DESCRIPTION OF THE DRAWINGS

The FIGURE is a schematic diagram of the preferred embodiment of a pneumatically driven hydraulic pump assembly constructed in accordance with the present invention.

DETAILED DESCRIPTION OF THE PREFERRED EMBODIMENT

The FIGURE is a schematic illustration of the preferred embodiment of a pneumatically driven hydraulic pump (hereinafter simply referred to as the pump assembly) constructed in accordance with the present invention and particularly adapted for use in a commercial transport airplane. The pump assembly provides makeup or auxiliary hydraulic power to the airplane hydraulic system to meet peak demand conditions. Additionally, the pump assembly is capable of providing continuous system hydraulic power during ground maintenance by connection to a ground-based power supply, and is also capable of providing continuous system power during in-flight emergency conditions.

The pump assembly responds automatically to provide makeup power in the event of a drop in system hydraulic pressure, such as occurs during retraction of the landing gear assembly after takeoff. Retraction of the landing gear requires a high hydraulic power output over a relatively short period of time. Other hydraulically powered components of the airplane that have similar power requirements are, for example, spoilers and flaps. Since the power demands of these components are intermittent and relatively infrequent, it is impractical to provide the airplane with a hydraulic power system having a continuous power output capacity sufficiently large to meet the occasional peak power requirements. Accordingly, the pump assembly operates essentially as an auxiliary power supply to meet the occasional peak power demands on the hydraulic system.

The pump assembly includes, generally, a variable displacement rotary hydraulic pump unit 10 coupled through a planetary reduction gear assembly 12 to an air-driven turbine 14. The pump unit 10, reduction gear assembly 12, and turbine 14 are contained in a casing 16. The assembly is ordinarily located, for example, in the wing/body fairing of the airplane fuselage.

The air turbine 14 is powered by bleed air conducted from one or more of the main engines of the airplane through a bleed air duct 18. The bleed air is supplied by the compressor stages of the engines and is delivered to the pump assembly at pressures of between approximately 25 and 65 psig, nominally 50 psig, and at temperatures of between approximately 355° to 450° F. After passing through the turbine 14, the bleed air is passed through an exhaust muffler 19 and exhausted through an outlet opening in the fuselage.

Referring more particularly to the integral pump and turbine assembly, the hydraulic pump unit 10 is a multipiston, variable displacement, pressure-compensated pump. A rotatable cylinder barrel 20 carries a set of reciprocating pistons 22 which are attached by cam followers 23 to a variable cam, or wobble plate 24. The wobble plate 24 is rotatable about a transverse trunion axis to vary the reciprocal displacement of the pistons 22 and thereby vary the fluid displacement of the pump unit 10. A bias spring 26 urges the wobble plate toward a normally tilted position corresponding to maximum pump displacement. In operation of the pump unit 10, hydraulic fluid is drawn into the piston cylinders through an input conduit 28 and discharged through an output conduit 30. The wobble plate 24 is tilted against the bias spring 26 toward a position of lower fluid displacement as the pressure in the output conduit 30 rises to the level of normal system operating pressure. More specifically, as the output pressure in conduit 30 increases, fluid from the output conduit 30 is supplied through a pressure-actuated valve 31 and through a conduit 32 to a hydraulic actuator 33 which operates to drive the wobble plate 26 to a relatively less tilted position of lower fluid displacement. Conversely, in the event of a drop in system hydraulic pressure in the output conduit 30, fluid is exhausted from the actuator 33 through conduit 32 and the pressure-actuated valve 31 to a hydraulic fluid return conduit 34, and the bias spring 26 tilts the wobble plate 24 toward a tilted, high-displacement position to increase the output of the pump unit 10.

A modulating valve 40 interposed in the bleed air duct 18 modulates the flow of air to the turbine 14 and thereby directly controls the speed of the turbine 14 as well as the rotary pump 10. The modulating valve 40 includes a four-inch diameter butterfly valve 42 which is mechanically coupled to a pneumatic actuator 44. The pneumatic actuator 44 is mechanically linked to the wobble plate 24 of the hydraulic pump unit 10 in a manner described below to form a mechanical-pneumatic control system.

The pneumatic actuator 44 includes a piston 46 coupled to the butterfly valve 42 and three pressure chambers; an opening chamber 48 which, when pressurized, operates to open the butterfly valve 42; a closing chamber 50; and an intermediate chamber 52, which augments the closing chamber 50. An actuator spring 54 located in the intermediate chamber urges the piston 46 toward the opening chamber 48 to thereby bias the bufferfly valve 42 in a normally closed position.

Control pressure for the pneumatic actuator 44 is supplied from the bleed air duct 18 at a point upstream from the modulating valve 40 through a control pressure conduit 56. The bleed air pressure on the upstream side of the modulating valve 40 is designated $P_M$ in FIG. 1. A reference pressure regulator 58 is interposed in the control pressure conduit 56 to maintain the control pressure at a substantially constant level. A normally open, solenoid-actuated shutoff valve 60 is also interposed in the control pressure conduit 56 to permit the modulating valve 40 to be disabled if desired.

A variable-position, two-way flow divider valve 62 directs control pressure from the control pressure conduit 56 to conduits 64 and 66, which are connected to the opening chamber 48 and the closing chamber 50, respectively. The flow divider valve 62 is continuously variable from a first position wherein control pressure is directed exclusively into the conduit 64, to effect closing of the butterfly valve 42, to a second position wherein control pressure is directed only into conduit 66 to open the butterfly valve 42. The flow divider valve 62 is mechanically coupled in any suitable manner to the wobble plate 24 so as to shunt control pressure increasingly through the conduit 64 to the opening chamber 48 in response to tilting of the wobble plate 24 toward positions of increasingly higher displacement. For example, when the hydraulic load on the pump unit 10 is at a maximum and the wobble plate 24 is tilted toward a position of maximum pump displacement, the flow divider valve 62 directs control pressure to the opening chamber 48 to open the butterfly valve 42 and admit bleed air to the turbine 14. As the pump speed increases to meet the hydraulic load, the wobble plate 24 ordinarily reverts toward a position of lesser hydraulic displacement and thereby causes the flow divider valve 62 to direct at least a portion of the control pressure to the closing chamber 50. In FIG. 1, a bellcrank 67 is illustrated schematically as an example of a mechanical linkage between the wobble plate 24 and the flow divider valve 62.

As described above, operation of the modulating valve 40 is primarily controlled by the mechanical linkage to the wobble plate 24 operating on the flow divider valve 62. A feedback conduit 68 is coupled to the bleed air duct 18 at a position downstream from the modulating valve 40 adjacent the inlet to the turbine 14. The conduit 68 applies the turbine inlet pressure (designated $P_1$ in FIG. 1) to the intermediate chamber 52 of the pneumatic actuator 44 where it acts on the back side of the piston 46 to augment the operation of the flow divider valve 62 in closing the valve 42 by increasing the pressure in the intermediate chamber 52. The conduit 68 thus provides a pneumatic feedback path to the actuator 44, whereby the butterfly valve 42 opens until the turbine inlet pressure in the intermediate chamber 52 operates, together with the actuator spring 54 and the pressure in the closing chamber 50, to balance the pressure in the opening chamber 48. When the opening and closing forces in the actuator 44 are equal, the position of the butterfly valve 42 is fixed so as to maintain a constant turbine inlet pressure.

Additionally, the turbine inlet pressure ($P_1$) is applied through the feedback conduit 68 to a spring-biased diaphragm actuator 70 which operates to directly modulate the flow divider valve 62. The conduit 68 and diaphragm actuator 70 effectively provide a second pneumatic feedback loop which augments the application of turbine inlet pressure to the intermediate chamber 52 and modulates the opening of the butterfly valve 42.

As described above, when the turbine 14 and the pump unit 10 reach a speed sufficient to meet the demand load on the hydraulic system, the wobble plate 24 shifts in position to reduce the displacement of the pump unit 10. Shifting of the wobble plate 24 toward lower displacement shifts the variable position flow divider valve 62 to proportionally increase the pneumatic pressure supplied to the closing chamber 50 relative to that supplied to the opening chamber 48. This causes the actuator 44 to rotate the butterfly valve 42 toward a closed position, in turn reducing turbine inlet pressure and turbine speed until an optimum match of the turbine speed to hydraulic demand is attained.

It will be apparent from the description thus far that, in the overall operation of the pump assembly, a change in the bleed air pressure in the duct 18 upstream from the modulating valve 40 ($P_M$) is, to some extent, compensated for by the mechanical control linkage connection between the wobble plate 24 and the modulating valve actuator 44. For example, a sudden increase in bleed air pressure upstream of the butterfly valve 42 ($P_M$) will cause both the turbine speed and the turbine inlet pressure to increase. Increasing the speed of the turbine 14 increases the displacement of the pump unit 10 and the output pressure in the conduit 30. The increase in hydraulic pressure in conduit 30 causes the wobble plate 24 to tilt and to ultimately partially close the modulating butterfly valve 42, thus compensating for the increase in bleed air pressure $P_M$. Also, the resulting increase in the turbine inlet pressure ($P_I$) is applied through the conduit 68 to the intermediate chamber 52 of the actuator 44 to urge the butterfly valve element 42 toward a closed position. Also, the increased turbine inlet pressure is applied to the diaphragm actuator 70 to act on the flow divider valve 62 to shunt control pressure away from the opening chamber 48 and into the closing chamber 50.

A pressure regulating valve 80 is interposed in the bleed air duct 18 upstream from the modulating valve 40. The primary purpose of the pressure regulating valve 80 is to minimize the pressure drop across the modulating valve 40 and thereby minimize the noise generated at the modulating valve 40. Additionally, the pressure regulating valve 80 operates to stabilize the pressure of the bleed air provided to the modulating valve 40 ($P_M$) and also operates as an emergency shutoff valve in the event of overspeed of the turbine 14.

The pressure regulating valve 80 is generally similar in structure to the modulating valve 40, and includes a butterfly valve 82 that is coupled to a piston 84 of a pneumatic actuator 86. The pneumatic actuator 86 includes an opening chamber 88, closing chamber 90, and intermediate chamber 92. An actuator spring 94 located in the intermediate chamber 92 urges the piston 84 toward the opening chamber 88 to maintain the valve element 82 in a normally closed position in the absence of any control pressure.

The pneumatic actuator 86 is controlled by bleed air supplied at a pressure designated $P_R$ via a control pressure conduit 96 which couples the actuator 86 to a point upstream from the pressure regulating valve 80. A reference pressure regulator 98, interposed in the control pressure conduit 96, operates to provide control pressure at a substantially constant level despite occasional fluctuations in the pressure of the bleed air ($P_R$) in the duct 18. A solenoid-actuated shutoff valve 100 is interposed in the control pressure conduit between the reference pressure regulator 98 and the actuator 86. The shutoff valve 100 is responsive to an electrical signal that is supplied by an overspeed sensor 102 which is coupled to the turbine 14 and closes the shutoff valve 100 in the event of an overspeed condition. This vents the opening chamber 88 of actuator 86 to the atmosphere so that the spring 94 forces the butterfly valve 82 into the closed position, thereby removing pneumatic power to the turbine 14. The overspeed signal from sensor 102 is terminated and the shutoff valve 100 opened by subsequent actuation of a manual reset switch (not shown).

The reference pressure regulator 98 is further coupled by a feedback conduit 104 to the bleed air duct 18 at a point upstream from the modulating valve 40. Additionally, the feedback conduit 104 is coupled to the closing chamber 90 of the pneumatic actuator 86. The feedback conduit 104 effectively complements the reference pressure regulator 98 to maintain the pressure on the modulating valve at a substantially constant level.

In one actual embodiment, the pressure regulating valve 80 is set to maintain the upstream pressure ($P_M$) on the modulating valve 40 at approximately 12.5 psig. The turbine 14 operates over a range of inlet pressures ($P_I$) of between zero and 12.5 psig, such that maintaining the pressure on the modulating valve 40 at 12.5 psig allows the modulating valve 40 to be operated between a closed position and a fully open position. This minimizes the pressure drop across the modulating valve 40 and thereby also minimizes the sound emitted from the valve 40. In particular, the pressure drop across the valve 40 is thereby reduced to zero with the valve wide open to obtain full speed of the turbine 14. Large pressure drops which result in supersonic airflow and resulting emission of high sound levels are avoided. In this regard, since supersonic airflow results only when the pressure drop across a valve is greater than approximately 50%, the modulating valve 40 does not produce appreciable noise due to supersonic airflow unless the turbine inlet pressure ($P_I$) is less than about 6 psig, i.e., except when the turbine 14 is being operated at relatively low speeds. Since noise levels are also directly related to the mass airflow rate across a valve, it happens that the noise levels at turbine inlet pressures of 6 psig and less, although generated to some extent by supersonic airflow, are relatively low and generally tolerable.

A muffler 106 is positioned in the bleed air duct 18 between the modulating valve 40 and the pressure regulating valve 80. The muffler is a straight-through, dissipative type muffler having a bulk absorber material 108 contained between coaxial inner and outer tubular members 110 and 112, respectively. The inner tubular member 110 is perforated to have approximately 37% open area. The bulk absorber material 108 may be formed of glass fiber or other suitable bulk absorber material. A layer of wire cloth (not shown) is preferably bonded to the outside of the perforated inner tubular member 110 to prevent particles of the bulk absorber 108 from being dislodged into the bleed air duct 18. In pratice, it is found that the muffler 106 provides a sound transmission loss of approximately 17 dBA (re $10^{-13}$ watts; all figures given below are also re $10^{-13}$ watts) at 4000 cps in the case of a regulating valve 80 having a sound power level of 135 dBA at 4000 cps. The purpose of the muffler 106 is to attenuate sound generated at the pressure regulating valve 80 prior to its reaching and passing through the modulating valve 40. As mentioned earlier, the muffler 106 cannot be located downstream from the modulating valve 40 because of the airflow lag that would be introduced. The feedback conduit 104 enables the pressure regulating valve 80 to effectively regulate the pressure immediately upstream from the pressure modulating valve 40 in order to compensate for the small pressure drop across the muffler 106.

The reduction in noise obtainable by regulating the upstream pressure on the modulating valve 40 is most significant with respect to case-radiated noise. In one analysis, with the turbine operating at a maximum speed (5683 rpm) and with an upstream pressure of 45 psig applied to the modulating valve 40, the total case-radiated noise of the pump assembly was 134 dBA and was determined to be attributable to the modulating valve 40 (134 dBA), the hydraulic pump 10 (118 dBA), the reduction gear assembly 12 (100 dBA), and the turbine 14 (105 dBA). By reducing the upstream pressure on the modulating valve 40 from 45 to 28 psig, the modulating valve noise was reduced to 126 dBA, with no change in the noise levels from the other components. This reduction in the modulating valve noise reduced the total case-radiated noise to 127 dBA, to obtain an overall noise reduction of 7 dBA.

The reduction in exhaust-radiated noise attendant to reduction of the upstream pressure on the modulating valve 40 is also significant, although not as pronounced as the reduction in case-radiated noise. For example, in one analysis, a reduction in the upstream pressure on the modulating valve 40 from 45 psig to 25 psig, with no change in the speed of the turbine, resulted in a reduction in exhaust-radiated noise from 147 dBA to 144 dBA, with the modulating valve 40 again being the primary and determinative noise contributor in the assembly.

As briefly mentioned above, the interposition of the pressure regulating valve 80 in the bleed air duct 18 upstream from the pressure modulating valve also operates to stabilize the bleed air pressure and thereby results in improved control responsiveness of the turbine. Since the bleed air supply system in a commercial transport airplane is typically subject to substantial pressure fluctuations, this advantage is obtained in addition to the noise reduction achieved by the present invention.

Although the present invention is described by reference to a preferred embodiment, it is understood that various alterations, modifications, and substitutions that may be apparent to one or ordinary skill in the art may be made without departing from the essential spirit of the invention. For example, although the invention is described by reference to an embodiment wherein the modulating valve 40 is operated under automatic feedback control, it will be understood that the invention is equally applicable where, for example, the modulating valve is operated manually to control the speed of the turbine. Accordingly, the scope of the invention is defined by the following claims.

The embodiment of the invention in which an exclusive property or privilege is claimed are as follows:

1. In pneumatically driven turbine machinery, wherein a modulating valve meters pressurized gas from a source of high pressure gas to a gas turbine with the modulating valve being operable to directly control the speed of the gas turbine by varying the pressure at which gas is supplied to the gas turbine, the improvement directed to reduction of noise emitted by said machinery, comprising pressure regulating means interposed between said source of high pressure gas and said modulating valve to reduce the pressure applied to the upstream side of said pressure modulating valve to a pressure sufficiently high to effectively control said turbine by operation of said modulating valve, said pressure regulating means thereby operating to reduce the noise level of said modulating valve and of said machinery.

2. The improvement defined in claim 1 wherein said pressure regulating means is a pressure regulator valve.

3. The improvement defined in claim 2 further including muffler means interposed between said pressure regulator valve and said pressure modulating valve.

4. The improvement defined in claim 3 wherein said pressure regulator valve operates in response to pressure supplied from a point between said muffler means and said modulating valve.

5. A method of minimizing noise produced in pneumatically driven turbine machinery wherein a modulating valve meters pressurized gas to a gas turbine from a source of pressurized gas, comprising:

regulating the upstream pressure applied to said modulating valve so as to reduce the pressure applied to said modulating valve to a level sufficient to obtain a full range of performance of said turbine by operation of said modulating valve, said pressure regulation operating to minimize the pressure drop across said modulating valve to thereby minimize noise produced at said modulating valve.

6. The method defined in claim 5 wherein said upstream pressure applied to said modulating valve is reduced to substantially the minimum pressure necessary to obtain a full range of performance of said gas turbine by operation of said modulating valve.

7. The method defined in claim 5 or 6 comprising the additional step of providing a muffler means upstream from said modulating valve, said pressure regulation being conducted upstream from said muffler means such that said muffler means attenuates noise generated by said pressure regulation.

8. The method defined in claim 7 wherein pressure regulation is conducted upstream from said muffler means and is responsive to pressure applied from a point between said muffler means and said modulating valve.

9. The method defined in claim 8 wherein said modulating valve is operable between a closed position and a fully open position and there is a negligible pressure drop across said valve in said fully open position, and wherein said step of regulating the pressure upstream from said modulating valve includes maintaining said pressure at a level substantially equal to the maximum input pressure of said turbine.

10. Improved pneumatically driven turbine apparatus of the type wherein a modulating valve meters pressurized gas to a gas turbine from a source of pressurized gas with the modulating valve being operable to directly control the speed of said gas turbine by varying the pressure of said gas supplied to said gas turbine, said gas being supplied through a conduit means from said source and said modulating valve being located in said conduit means, the improvement directed to reducing noise generated by said modulating valve comprising:

a pressure regulator valve positioned in said conduit means between said modulating valve sand said source of pressurized gas, said pressure regulator valve operating to reduce the pressure applied to the upstream side of said modulating valve to a level sufficient to control said turbine by operation of said modulating valve.

11. The apparatus defined in claim 10 further comprising muffler means interposed in said conduit means between said modulating valve and said pressure regulator valve to attenuate noise generated by said pressure regulator valve.

12. The apparatus defined in claim 11 further comprising a second conduit means coupling said pressure regulator valve to said conduit means at a point between said muffler means and said pressure modulating valve, said pressure regulator being responsive to pressure applied through said second conduit means to maintain the pressure applied to said modulating valve at a substantially constant level.

13. The apparatus defined in claim 11 or 12 wherein said pressure regulator valve operates to reduce the pressure applied to the upstream side of said modulating valve to substantially the minimum level necessary to obtain a full range of performance of said turbine by operation of said modulating valve, whereby said modulating valve may thereby be operated between a closed position and a fully open position wherein there is substantially no pressure drop across said modulating valve.

* * * * *

UNITED STATES PATENT AND TRADEMARK OFFICE

CERTIFICATE OF CORRECTION

PATENT NO. : 4,426,845

DATED : January 24, 1984

INVENTOR(S) : Brooks et al.

It is certified that error appears in the above-identified patent and that said Letters Patent is hereby corrected as shown below:

| | |
|---|---|
| Column 1, | line 1: insert --A-- after "IN"<br>line 2: "DRIVE" should be --DRIVEN-- |
| Column 9, | line 61: "or" should be --of-- |
| Column 11, | line 8: "sand" should be --and-- |
| Cover Page: In the Title [54] | line 1: insert --A-- after "IN"<br>line 2: "DRIVE" should be --DRIVEN-- |

Signed and Sealed this

*Fifth* Day of *February 1985*

[SEAL]

*Attest:*

DONALD J. QUIGG

*Attesting Officer* *Acting Commissioner of Patents and Trademarks*